US012679628B2

(12) United States Patent
Ros et al.

(10) Patent No.: US 12,679,628 B2
(45) Date of Patent: Jul. 14, 2026

(54) TRANSPORT CONTAINER FOR TRANSPORTING TEMPERATURE-SENSITIVE GOODS TO BE TRANSPORTED, SAID CONTAINER COMPRISING CONTAINER WALLS

(71) Applicant: REP IP AG, Zug (CH)

(72) Inventors: Nico Ros, Riehen (CH); Stefan Retzko, Zürich (CH)

(73) Assignee: REP IP AG, Zug (CH)

( * ) Notice: Subject to any disclaimer, the term of this patent is extended or adjusted under 35 U.S.C. 154(b) by 215 days.

(21) Appl. No.: 18/692,458

(22) PCT Filed: Sep. 15, 2022

(86) PCT No.: PCT/IB2022/058700

§ 371 (c)(1),
(2) Date: Mar. 15, 2024

(87) PCT Pub. No.: WO2023/042110

PCT Pub. Date: Mar. 23, 2023

(65) Prior Publication Data

US 2025/0121998 A1 Apr. 17, 2025

(30) Foreign Application Priority Data

Sep. 17, 2021 (AT) ..... 155/2021

(51) Int. Cl.
*B65D 81/38* (2006.01)
*B65D 81/18* (2006.01)

(52) U.S. Cl.
CPC ..... *B65D 81/3823* (2013.01); *B65D 81/18* (2013.01); *B65D 81/3816* (2013.01); *B65D 81/3818* (2013.01)

(58) Field of Classification Search
CPC ..... B65D 81/3823; B65D 81/18; B65D 81/3816; B65D 81/3818; F25D 2303/085;
(Continued)

(56) References Cited

U.S. PATENT DOCUMENTS 6,666,032 B1 * 12/2003 Rickson ..... F25D 3/06 62/3.6
8,171,984 B2 * 5/2012 Christ ..... F28F 21/02 165/185

(Continued)

FOREIGN PATENT DOCUMENTS

DE 202018102967 U1 6/2018
EP 1156097 A1 11/2001

(Continued)

OTHER PUBLICATIONS

International Search Report and Written Opinion received in PCT/IB2022/058700 dated Nov. 25, 2022, pp. 13.

(Continued)

*Primary Examiner* — Steve S Tanenbaum

(57) ABSTRACT

A transport container for transporting temperature-sensitive goods to be transported, the container including container walls which surround and close off all sides an inner space provided for receiving the goods to be transported. Each container wall has at least one latent-heat storage layer which includes a phase change material, and preferably the latent-heat storage layers of adjacent container walls are connected to one another in a thermally conductive manner. A material which increases the thermal conductivity of the latent-heat storage layers in at least one direction is introduced into the phase change material.

13 Claims, 2 Drawing Sheets

(58) Field of Classification Search
CPC ... F25D 3/06; F25D 3/08; F28D 20/02; F28D 2020/0008
USPC ..... 62/457.2
See application file for complete search history.

(56) References Cited

U.S. PATENT DOCUMENTS

| | | | | |
|---|---|---|---|---|
| 8,580,171 | B2 * | 11/2013 | Christ | C09K 5/063 264/122 |
| 10,781,350 | B2 * | 9/2020 | Rinn | F28F 21/02 |
| 10,897,892 | B1 * | 1/2021 | Sole | A01N 1/162 |
| 2004/0084658 | A1 * | 5/2004 | Ottinger | C09K 5/063 252/500 |
| 2008/0099492 | A1 * | 5/2008 | Mayer | B65D 81/3816 220/592.2 |
| 2011/0247356 | A1 * | 10/2011 | Krosse | F25B 27/002 220/592.2 |
| 2015/0166244 | A1 * | 6/2015 | Wood | B31B 50/74 220/592.25 |
| 2017/0038114 | A1 * | 2/2017 | Ros | A61J 1/165 |
| 2017/0038116 | A1 * | 2/2017 | Ros | F25D 11/006 |
| 2020/0237126 | A1 * | 7/2020 | Booska | A47G 19/2266 |
| 2020/0408471 | A1 * | 12/2020 | Zhang | E04B 1/7608 |
| 2021/0188128 | A1 * | 6/2021 | Chopard | H01M 10/625 |

FOREIGN PATENT DOCUMENTS

| | | | |
|---|---|---|---|
| EP | 3128266 | A1 | 2/2017 |
| WO | 2008006669 | A1 | 1/2008 |
| WO | 2021024061 | A1 | 2/2021 |

OTHER PUBLICATIONS

Frusteri et al., "Thermal Conducivity Measurement of a PCM Based Storage System Containing Carbon Fibers," Applied Thermal Engineering, Pergamon, Oxford, vol. 25. No. 11-12, Aug. 1, 2005 pp. 1623-1633.

* cited by examiner

TRANSPORT CONTAINER FOR TRANSPORTING TEMPERATURE-SENSITIVE GOODS TO BE TRANSPORTED, SAID CONTAINER COMPRISING CONTAINER WALLS

CROSS-REFERENCE TO RELATED APPLICATIONS

The present application is a national phase application of PCT Application No. PCT/IB2022/058700, filed Sep. 15, 2022, entitled "TRANSPORT CONTAINER FOR TRANSPORTING TEMPERATURE-SENSITIVE GOODS TO BE TRANSPORTED, SAID CONTAINER COMPRISING CONTAINER WALLS", which claims the benefit of Austrian Patent Application No. A 155/2021, filed Sep. 17, 2021, each of which is incorporated by reference in its entirety.

BACKGROUND OF THE INVENTION

1. Field of the Invention

The invention relates to a transport container for transporting temperature-sensitive goods, comprising container walls which surround and close off on all sides an inner space provided for receiving the goods, wherein each container wall has at least one latent heat storage layer which comprises a phase change material, and wherein preferably the latent heat storage layers of adjacent container walls are connected to one another in a thermally conductive manner.

2. Description of the Related Art

When transporting temperature-sensitive goods, such as medicinal products, over periods of several hours or days, specified temperature ranges must be maintained during storage and transportation in order to ensure the usability and safety of the medicinal product. Temperature ranges of 2 to 25° C., in particular 2 to 8° C., are specified as storage and transportation conditions for various medicinal products.

The desired temperature range can be above or below the ambient temperature, so that either cooling or heating of the inner space of the transport container is required. If the ambient conditions change during a transportation process, the required temperature control can include both cooling and heating. To ensure that the desired temperature range is permanently and verifiably maintained during transportation, transport containers with special insulation properties are used. These containers are equipped with passive or active temperature control elements. Passive temperature control elements do not require an external energy supply during use, but utilize their heat storage capacity, whereby, depending on the temperature level, heat is released or absorbed to or from the inner space of the transport container to be temperature-controlled. However, such passive temperature control elements are exhausted as soon as the temperature equalization with the inner space of the transport container is complete.

A special form of passive temperature control elements are latent heat accumulators, which can store thermal energy in phase change materials whose latent heat of fusion, heat of solution or heat of absorption is significantly greater than the heat they can store due to their normal specific heat capacity. The disadvantage of latent heat accumulators is that they lose their effect as soon as the entire material has completely undergone the phase change. However, the latent heat accumulator can be recharged by carrying out the opposite phase change.

One problem with transport containers of the type mentioned above is that the energy input into the transport container during transportation is heterogeneous. If the container is exposed to heat radiation, the energy input in the area of the radiation effect is significantly greater than in the areas in which no radiation acts on the container. Nevertheless, the temperature inside the container must be kept constant and homogeneous within a permissible range. The problem with inhomogeneous energy input is that the latent heat storage is not used up homogeneously. This results in local temperature changes in the inner space of the transport container after a certain time. If the local temperature changes exceed or fall below a certain threshold value, the transported goods are no longer protected.

Transport containers are therefore usually designed so that each side functions independently. This means that each side must be designed for the maximum possible heat load. However, the energy potential of one area cannot be used for another area. If, for example, heat radiation acts on the transport container from above, this energy is absorbed by the latent heat storage element in the upper area, where it undergoes a phase transition. As soon as the phase transition has taken place, the energy enters the inner space of the container and leads to heating in the upper area of the container. The remaining energy absorption potential of the latent heat storage element in the lower area cannot be utilized. This means that in conventional transport containers, where the temperature is controlled with latent heat storage elements, each side is designed independently for the maximum expected thermal energy input. However, this leads to a significant increase in weight and/or volume. Both lead to a significant loss of efficiency during transportation. Pharmaceutical products are usually transported by airplane, where even a small increase in weight or volume leads to significant additional costs.

To solve this problem, EP 3128266 A1 proposed to arrange an energy distribution layer made of a highly thermally conductive material on the side of the latent heat storage unit facing away from and/or towards the inner space. This makes it possible to distribute the thermal energy acting from the outside, e.g. only on one side of the transport container, in particular as heat radiation, to the other sides of the container. If the energy distribution layer surrounds the inner space of the transport container on all sides, the thermal energy acting on it is distributed over the entire circumference of the container shell. The energy distributed in this way is transferred to the inner layers of the container wall and leads to uniform consumption of the latent heat storage layer over the entire extent of the latent heat storage layer. The volume of the latent heat storage material to be provided must therefore not be designed for the maximum energy input that can be expected from each side, but for the sum of the energy input that can be expected from all sides. Since it can be assumed that not every side of the transport container is exposed to the maximum expected energy input, the total volume of the latent heat storage material can be reduced.

However, the arrangement of energy distribution layers increases the weight of the transport container and also reduces the volume available for holding the transported goods in the inner space.

SUMMARY OF THE INVENTION

The present invention therefore aims to overcome the above-mentioned disadvantages and, in particular, to maximize the volume of the transport container that can be used for the transported goods without impairing the temperature retention capacity. This should reduce the transportation costs per unit of weight of the transported goods.

To solve this problem, the invention essentially provides, in a transport container of the type mentioned at the beginning, that a material increasing the thermal conductivity of the latent heat storage layers in at least one direction is introduced into the phase change material. By increasing the thermal conductivity of the latent heat storage layers, the locally introduced heat is distributed more evenly over the entire latent heat storage. This allows a larger proportion of the stored enthalpy to be used and increases the efficiency of the transport container. Because the heat distribution takes place in the latent heat storage layers themselves due to the material introduced into the phase change material instead of achieving this with the aid of separate energy distribution layers adjacent to the latent heat storage layer, the increase in weight and space consumption caused by the energy distribution layers is avoided.

In the present description, the terms container wall or container walls are synonymous with the terms wall or walls also used. Furthermore, a door described herein is also deemed to be a container wall, unless this is expressly expressed in a different sense.

If the latent heat storage layers of adjacent container walls are connected to each other in a thermally conductive manner in a preferred design, temperature equalization occurs not only within the respective latent heat storage layer, but also between adjacent latent heat storage layers. As the latent heat storage layers are arranged in each container wall, the temperature is equalized over the entire circumference of the container.

The transport container is preferably designed as a cuboid container which has six container walls arranged at right angles to each other, each of which contains a latent heat storage layer according to the invention. One of the container walls can be designed as a door, e.g. as a hinged door, in particular as a double-leaf hinged door. The container walls comprise a wall for the floor, two side walls, a rear wall, a wall for the ceiling and a wall at the front for the door.

The latent heat storage layers preferably extend over the entire extent of the corresponding wall, so that the latent heat storage layers of neighboring walls adjoin each other. This can be achieved by arranging a single plate-like latent heat storage element per wall, which is adjacent to the latent heat storage element of the respective neighboring wall. Alternatively, a number of plate-like latent heat storage elements can be provided for each wall, which are connected to each other in a heat-conducting manner to distribute the heat over the entire wall. In both cases, this results in heat distribution over the entire height of the inner space of the container, which leads to the following advantage with larger containers. If the closed container is placed in a room that is below the phase transition temperature of the phase change material, the phase change material is recharged by causing the phase transition. However, this is not the case with a container that does not have the heat distribution capability according to the invention, because the warm air in the inner space of the container still rises to the top. If such a closed container is placed in a room that is below the phase transition temperature of the phase change material, the phase change material in the area near the bottom of the container charges up first because the air rising upwards in the inner space prevents homogeneous charging. The phase change material in the upper area of the container only charges after the phase change material in the lower area is fully charged, i.e. is below the phase transition temperature. This means that short stops of the container in warehouses with a temperature below the phase transition temperature during the transport process cannot be used for recharging, i.e. to increase the running time.

Preferably, the latent heat storage layers of adjacent container walls are connected to each other in a thermally conductive manner so that, for example, one of the container walls is thermally connected to a container wall opposite the inner space. As a result, heat is distributed around the circumference of the container. The thermally conductive connection of adjacent container walls is preferably designed in such a way that the thermal conductivity from one wall to the adjacent wall is at least 5 W/mK, preferably at least 50 W/mK, preferably at least 100 W/mK.

In principle, the increase in the thermal conductivity of the latent heat storage layers can be achieved by any foreign material introduced into the phase change material that has a higher thermal conductivity than the phase change material. However, an effective increase in thermal conductivity is achieved if the material introduced has a significantly higher thermal conductivity in at least one direction than the phase change material. Preferably, the introduced material has a thermal conductivity in at least one direction of >190 W/mK, in particular >300-380 W/mK.

The material that increases the thermal conductivity is preferably made of graphite or expanded graphite. Expanded graphite is characterized by its low weight and can theoretically have a thermal conductivity of up to 600 W/mK. Expanded graphite (also known as exfoliated graphite) is produced by inserting foreign components (intercalates) between the lattice layers of graphite. Such expandable graphite intercalation compounds are usually produced by dispersing graphite particles in a solution containing an oxidizing agent and the intercalation compound. Commonly used oxidizing agents are nitric acid, potassium chlorate, chromic acid, potassium permanganate and the like. Concentrated sulphuric acid, for example, is used as the intercalation compound. When heated to a temperature above the so-called onset temperature, the expandable graphite intercalation compounds are subject to a strong increase in volume with expansion factors of more than 200, which is caused by the fact that the intercalation compounds embedded in the layer structure of the graphite are decomposed by the rapid heating to this temperature with the formation of gaseous substances, whereby the graphite layers are driven apart like accordions, i.e. the graphite particles are expanded or inflated perpendicular to the layer plane.

According to a preferred embodiment, the material that increases the thermal conductivity is present in the form of particles that are distributed within the phase change material.

Alternatively, the material that increases the thermal conductivity can be present in the form of at least one plate that is embedded in the phase change material. A plate of expanded graphite can be produced, for example, by compacting the fully expanded graphite under the directional effect of pressure, with the layer planes of the graphite preferably arranged perpendicular to the direction in which the pressure is applied, with the individual aggregates interlocking with one another.

In view of the high thermal conductivity of the introduced material, a relatively small amount of material is sufficient to significantly increase the thermal conductivity of the latent heat storage layer. Preferably, the material that increases the thermal conductivity takes up 3-10% by volume of the total volume of the phase change material.

Preferably, the material that increases the thermal conductivity has a direction-dependent thermal conductivity and is incorporated into the phase change material in such a way that the latent heat storage layer has a higher thermal conductivity in the layer plane of the respective latent heat storage layer than perpendicular to the layer plane. This leads to improved heat distribution in the circumferential direction and at the same time to a heat-insulating effect in the radial direction, i.e. from the surroundings into the inner space of the transport container and vice versa. The direction-dependent thermal conductivity can be achieved, for example, by using particles of the introduced material, such as particles of expanded graphite in particular.

The layer planes of the expanded graphite are arranged essentially parallel to each other and parallel to the plane of the latent heat storage layer, as is possible, for example, with the expanded graphite plate described above. The thermal conductivity of the expanded graphite is high along its outer surface, but low when passing through the material. This dual functionality leads on the one hand to the desired heat distribution in the layer plane and on the other hand to a reduction of the heat input into the transported goods across the layer plane.

According to a preferred embodiment, the thermal conductivity of the latent heat storage layer in the layer plane is at least 2 times, preferably at least 5 times, preferably at least 10 times, in particular at least 50 times the thermal conductivity perpendicular to the layer plane.

In particular, the thermal conductivity of the latent heat storage layer in the layer plane can be at least 5 W/mK, preferably at least 50 W/mK, preferably at least 100 W/mK, in particular at least 500 W/mK, and the thermal conductivity of the latent heat storage layer perpendicular to the layer plane can be between 0.2 W/mK and 10 W/mK.

Alternatively, the particles of expanded graphite can also be arranged in a non-oriented manner in the phase change material so that the thermal conductivity of the latent heat storage layer is increased uniformly in all directions. The same effect is achieved if conventional graphite powder is incorporated into the phase change material instead of expanded graphite.

In order to further increase the heat distribution, it may be provided that each container wall comprises an energy distribution layer made of a material with a thermal conductivity $\lambda>80$ W/mK, preferably $\lambda>150$ W/mK, on the side of the at least one latent heat storage layer facing away from the inner space and/or on the side of the at least one latent heat storage layer facing the inner space, the energy distribution layers of adjacent container walls being connected to each other in a thermally conductive manner, in particular being arranged in contact with each other. This means that the enthalpy stored in the latent heat storage elements on the adjacent walls can also be used and the overall efficiency of the transport container can be further improved.

The energy distribution layers can consist at least partially, preferably completely, of aluminum, copper, carbon nanotubes or expanded graphite. In particular, the energy distribution layers are each formed by a plate made of one of the aforementioned materials.

The energy distribution layers or plates preferably surround the inner space of the transport container on all sides and without gaps. The energy distribution layers or plates thus form a shell in which the transported goods are located, for example. Depending on whether the energy distribution layers or plates are arranged on the side of the latent heat storage layer facing away from and/or towards the inner space, an outer and/or an inner shell is formed. In the case of a cuboid transport container, each of the six container walls is preferably assigned an energy distribution layer or plate, so that the said shell is made up of six energy distribution layers or plates. The energy distribution layers or plates, in particular their edge areas, preferably touch each other directly, so that heat is equalized around the entire interior, whereby heat can be conducted via the shell of energy distribution layers or plates, for example from one side of the inner space to an opposite side.

According to a preferred further development, the circumferential energy distribution is favored by the fact that each container wall on the side of the at least one latent heat storage layer facing away from the inner space has an insulating layer made of a heat-insulating material with a thermal conductivity perpendicular to the layer plane of <0.04 W/mK, preferably <0.01 W/mK. The insulating layer reduces the energy flow in a radial direction towards the inner space of the transport container. The insulating layer preferably surrounds the inner space of the transport container on all sides.

The insulating layer can preferably consist of vacuum panels, polyisocyanurate (PIR), expanded polystyrene (EPS), extruded polystyrene foam (XPS) or ISOPET. The insulating layer can also have a honeycomb structure. An advantageous design results if the insulating layer has a plurality of hollow chambers, in particular honeycomb-shaped hollow chambers, whereby a honeycomb structural element according to WO 2011/032299 A1 is particularly advantageous.

The latent heat storage layer is preferably designed as a flat chemical latent heat storage layer, whereby conventional materials can be used for the phase change material it contains. Preferred media for the phase change material are kerosenes and salt mixtures. The phase transition of the phase change material is preferably in the temperature range of 2-10° C. or 2-25° C. or −82 to −72° C. or −15 to −30° C.

The transport container according to the invention is preferably designed as an air freight container and therefore preferably has external dimensions of at least 0.4×0.4×0.4 $m^3$, preferably 0.4×0.4×0.4 $m^3$ to 1.6×1.6×1.6 $m^3$, preferably 1.0×1.0×1.0 $m^3$ to 1.6×1.6×1.6 $m^3$.

BRIEF DESCRIPTION OF THE DRAWINGS

The invention is explained in more detail below with reference to embodiments shown schematically in the drawing. Therein.

DETAILED DESCRIPTION

Figure 1:
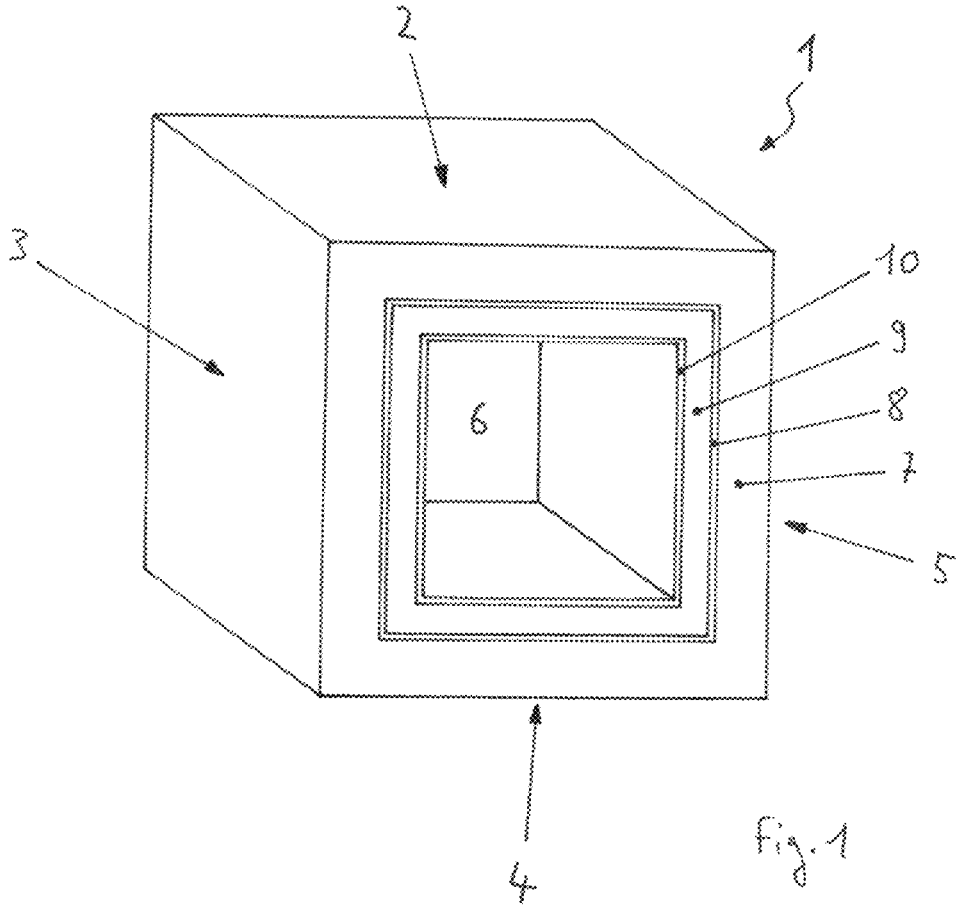
FIG. 1 shows a schematic representation of the transport container according to the invention.

FIG. 1 shows a cuboid transport container 1, the walls of which are labeled 2, 3, 4, 5 and 6. On the sixth side, the transport container 1 is shown open so that the layered structure of the walls can be seen. The open side can be closed, for example, by means of a door that has the same layered structure as walls 2, 3, 4, 5 and 6. The six walls of the transport container 1 all have the same layer structure. The layered structure comprises an insulating layer 7, an outer energy distribution layer 8, a latent heat storage layer 9, in which a highly thermally conductive material, such as expanded graphite, is incorporated, and an inner energy distribution layer 10.

Figure 2:
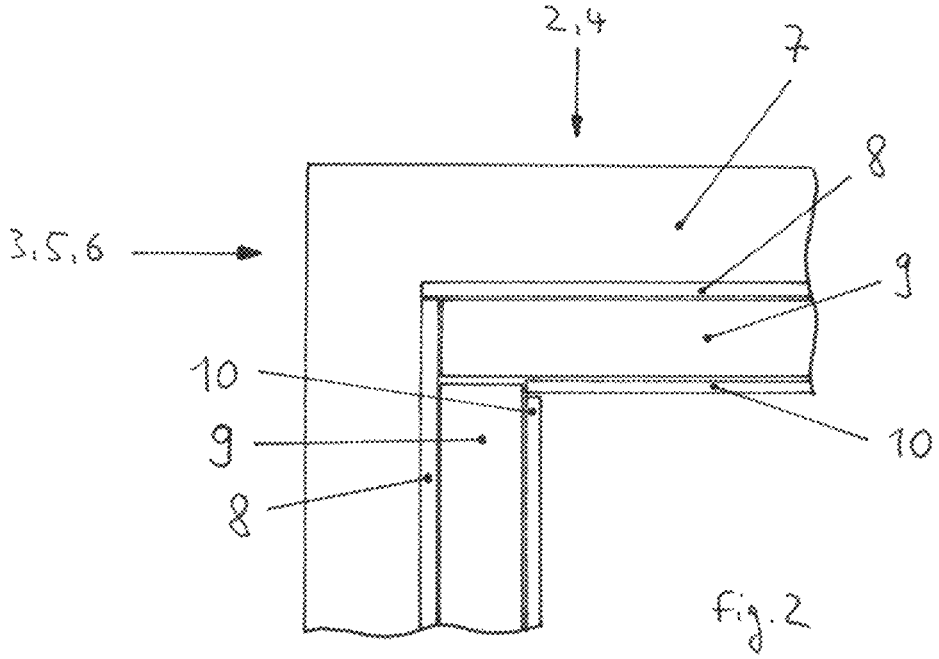
FIG. 2 shows a detailed view of the corner connection between the ceiling and the floor with the side walls and rear wall of the transport container.

FIG. 2 shows the corner connection between the ceiling 2 and the floor 4 with the side walls 3, 5 and the rear wall 6 of the transport container 1. The outer heat distribution layers 8 and inner heat distribution layers 10 are connected to each other via the corner in such a way that optimum heat conduction takes place without heat reaching the inside of the transport container. The latent heat storage elements 9 with the highly thermally conductive material are located between the inner and outer heat distribution layers.

Figure 3:
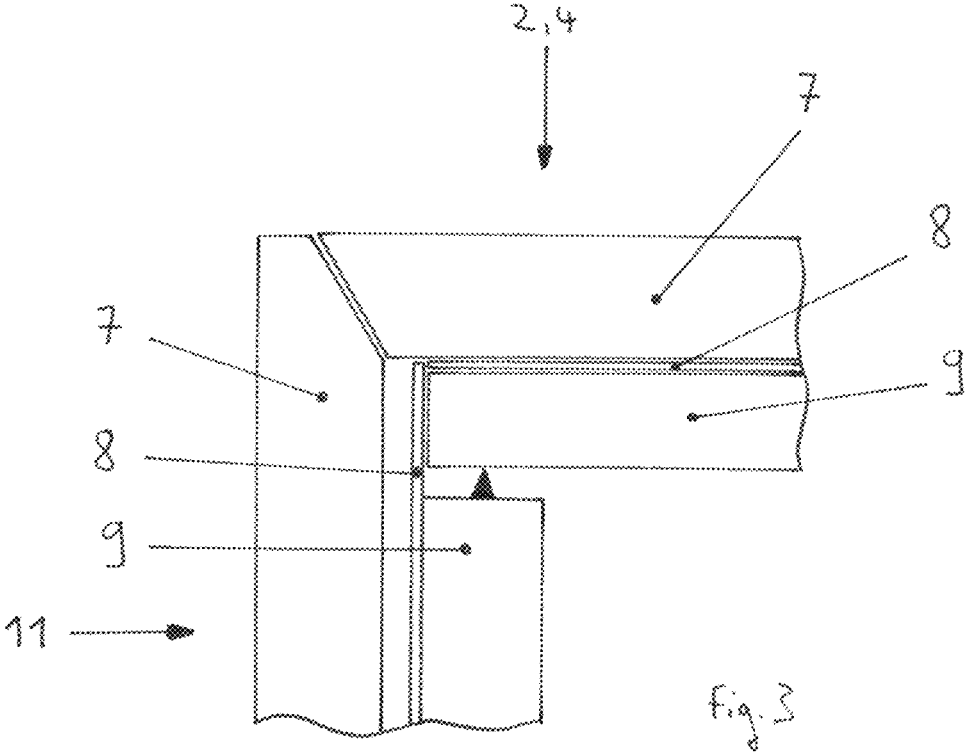
FIG. 3 shows a detailed view of the corner connection between the ceiling and the floor with the door of the transport container.

FIG. 3 shows the corner connection between the ceiling 2, the floor 4 and the door 11 of the transport container 1. The door 11 consists of an insulating layer 7, an outer heat distribution layer 8 and a latent heat storage 9 with highly thermally conductive material. The outer heat distribution layer 8 of the door 11 is connected to the heat distribution layer 8 in the floor 4 and ceiling 2 in such a way that optimum heat conduction takes place without heat reaching the inside of the transport container. For this purpose, the heat distribution layer 8 in the door 11 is extended outwards to such an extent that contact is made with the heat distribution layers 8 in the ceiling 2 and floor 4. The latent heat storage elements 9 with highly thermally conductive material are located at the inner side of the outer heat distribution layer 8.

Figure 4:
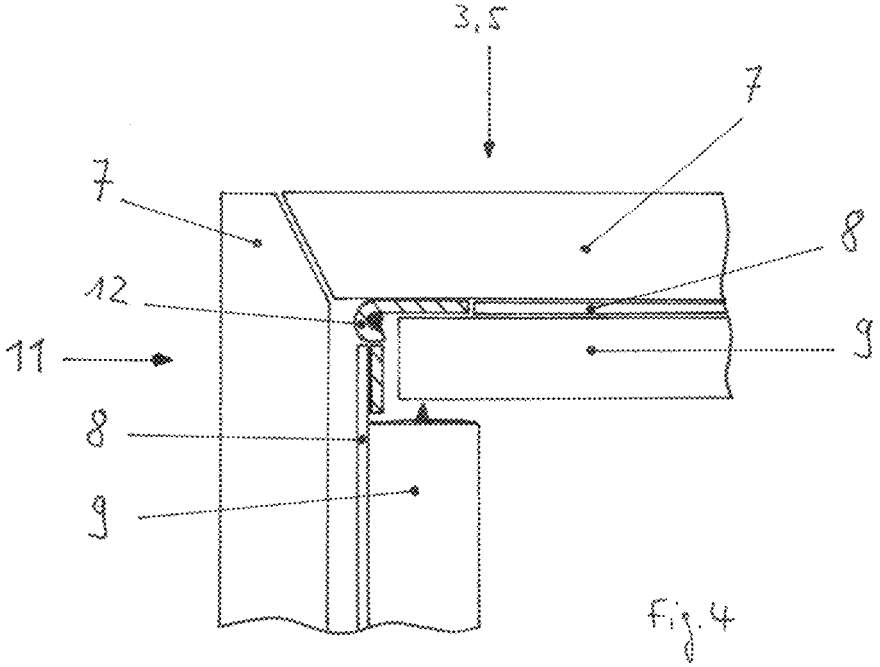
FIG. 4 shows a detailed view of the corner connection between the side walls with the door of the transport container.

FIG. 4 shows the corner connection between the side walls 3, 5 and the door 11 of the transport container 1. The door 11 consists of an insulating layer 7, an outer heat distribution layer 8 and a latent heat storage 9 with highly thermally conductive material. The outer heat distribution layer 8 of the door 11 is connected to the heat distribution layer 8 in the floor 4 and ceiling 2 in such a way that optimum heat conduction takes place without heat reaching the inside of the transport container. Thermal contact is achieved at the sides by an aluminum door hinge 12. The latent heat storage elements 9 with highly thermally conductive material are located at the inner side of the outer heat distribution layer 8.

The insulating layer 7 is designed as a high-performance insulation and preferably has a thermal conductivity of 0.02 W/mK to 0.3 W/mK. It consists either of vacuum panels (VIP), PIR, EPS, XPS, ISOPET or is designed as ultra-insulation.

The invention claimed is:

1. A transport container for transporting temperature-sensitive goods, comprising:

container walls surrounding and closing off on all sides an inner space provided for receiving the goods;

wherein each container wall has at least one latent heat storage layer comprising a phase change material;

wherein a material increasing a thermal conductivity of the latent heat storage layers in at least one direction is introduced into the phase change material; and wherein the material increasing the thermal conductivity has a direction-dependent thermal conductivity and is introduced into the phase change material so that the latent heat storage layer has a higher thermal conductivity in a layer plane of the respective latent heat storage layer than perpendicular to the layer plane.

2. The transport container according to claim 1, wherein the latent heat storage layers of adjacent container walls are connected to one another in a thermally conductive manner.

3. The transport container according to claim 1, wherein the material increasing the thermal conductivity is formed by one of graphite and expanded graphite.

4. The transport container according to claim 1, wherein the material increasing the thermal conductivity is present in a form of particles distributed within the phase change material.

5. The transport container according to claim 1, wherein the material increasing the thermal conductivity is present in a form of at least one plate embedded in the phase change material.

6. The transport container according to claim 1, wherein the material increasing the thermal conductivity takes up 3-10% by volume of a total volume of the phase change material.

7. The transport container according to claim 1, wherein the thermal conductivity of the latent heat storage layer in the layer plane is at least 2 times the thermal conductivity perpendicular to the layer plane.

8. The transport container according to claim 1, wherein the thermal conductivity of the latent heat storage layer in the layer plane is at least 5 W/mK and the thermal conductivity of the latent heat storage layer perpendicular to the layer plane is between 0.2 W/mK and 10 W/mK.

9. The transport container according to claim 1, wherein each container wall has, on a first side of the at least one latent heat storage layer facing away from the inner space, an insulating layer of a heat-insulating material with a thermal conductivity perpendicular to the layer plane of <0.04 W/mK.

10. The transport container according to claim 9, wherein the insulating layer consists of one of vacuum panels, polyisocyanurate (PIR), expanded polystyrene (EPS), extruded polystyrene foam (XPS), and ISOPET.

11. The transport container according to claim 1, wherein:

each container wall comprises an energy distribution layer made of a material with a thermal conductivity $\lambda>80$ W/mK on at least one of:

a first side of the at least one latent heat storage layer facing away from the inner space; and a second side of the at least one latent heat storage layer facing the inner space; and the energy distribution layers of adjacent container walls are connected to one another in a thermally conductive manner.

12. The transport container according to claim 11, wherein the energy distribution layer of each container wall consists at least partially of one of aluminium, copper, carbon nanotubes, and expanded graphite.

13. The transport container according to claim 12, wherein the energy distribution layer of each container wall consists completely of one of aluminium, copper, carbon nanotubes, and expanded graphite.

* * * * *